US007465112B2

(12) United States Patent
Qiu

(10) Patent No.: US 7,465,112 B2
(45) Date of Patent: Dec. 16, 2008

(54) AIRTIGHT RETRACTABLE WRITING DEVICE

(75) Inventor: Zhiming Qiu, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 570 days.

(21) Appl. No.: 11/170,713

(22) Filed: Jun. 28, 2005

(65) Prior Publication Data

US 2006/0002757 A1 Jan. 5, 2006

(30) Foreign Application Priority Data

Jun. 28, 2004 (CN) ..... 2004 1 01551440

(51) Int. Cl.
*B43K 5/16* (2006.01)

(52) U.S. Cl. ..... 401/107; 401/108; 401/99

(58) Field of Classification Search ..... 401/107, 401/108, 99
See application file for complete search history.

(56) References Cited

U.S. PATENT DOCUMENTS 3,292,593 A * 12/1966 Furuya ..... 401/107
3,315,395 A 4/1967 Kirklen
3,427,112 A * 2/1969 Tadashi et al. ..... 401/107
4,560,298 A * 12/1985 Oki et al. ..... 401/107
4,575,271 A * 3/1986 Hashimoto et al. ..... 401/107
4,629,348 A * 12/1986 Hashimoto et al. ..... 401/107
5,048,990 A * 9/1991 Hashimoto et al. ..... 401/107
5,915,867 A * 6/1999 Hashimoto ..... 401/108
6,135,660 A 10/2000 Stevens et al.
6,231,257 B1 5/2001 Stevens
6,866,436 B2 * 3/2005 Kanari et al. ..... 401/108
D508,530 S 8/2005 Qiu
6,981,812 B1 * 1/2006 Hsieh ..... 401/108
7,341,388 B2 * 3/2008 Carroll ..... 401/107

* cited by examiner

*Primary Examiner*—Khoa D Huynh
(74) *Attorney, Agent, or Firm*—Christensen O'Connor Johnson Kindness PLLC

(57) ABSTRACT

A retractable writing device is provided that contains a nib airtight unit with a lid. The nib airtight unit with a lid includes an airtight body, an airtight lid, and/or an elastic loop. The nib airtight unit with a lid is capable of providing effective and durable airtight function for various shapes of nibs.

13 Claims, 4 Drawing Sheets

AIRTIGHT RETRACTABLE WRITING DEVICE

FIELD OF THE INVENTION

This invention relates to a writing device and, more particularly, to a writing device containing volatile writing material.

BACKGROUND OF THE INVENTION

It is known for a pen to adopt a pushing structure that enables the nib of the pen to be retracted. When such a pen is in use, the nib extends outside the shaft of the pen. When not in use, the nib is retracted back into the shaft of the pen. Such a pushing and retractable design enables convenient and portable use of a pen and hence is very popular. However, when the writing material used in a pen, such as a fluorescent pen or marker, is volatile, even a retractable approach does not prevent the writing material from drying. To solve the problem of volatility, an airtight unit can be added to a retractable nib design to ensure that the nib of a volatile pen not only can stretch out and draw back freely, but also is protected against drying when drawn back into the shaft of the pen.

U.S. Pat. Nos. 6,135,660 and 6,231,257 disclose a pen with an airtight unit for the nib of the pen. The nib airtight unit disclosed in these two patents uses a couple of airtight balls made of elastic and soft materials such as rubber to make up a sealing arrangement to protect the nib of a pen. When not in use, the nib draws back and is isolated in a compartment sealed by both balls. While in use, the nib passes through the two balls. At the same time, the balls change shape and roll until the nib stretches out for writing. Such an airtight unit design has severe shortcomings. For example, the airtight balls can easily become wearied and torn because of the friction that results from pressing and rolling. The airtight balls may thus quickly fail to protect the nib of the pen. In addition, the shape of balls may limit the possible shapes of the nib of a pen.

Therefore, there exists a need for an airtight unit for a writing device such as a pen that effectively encloses a retracted nib, that is durable, and that is able to accommodate a variety of nib shapes.

BRIEF SUMMARY

Embodiments of the invention address the above-identified needs by providing a retractable writing device that includes a nib airtight unit with a lid. The nib airtight unit is capable of providing effective, stable, and durable protection of various shapes of nibs.

In one aspect, an airtight retractable writing device includes a shaft, an ink-box in the shaft, a nib connected with the ink-box, and a retractable unit controlling movement of the nib. The writing device further includes a nib airtight unit with a lid for enclosing the nib when the nib is retracted inside the shaft.

In accordance with another aspect, the nib airtight unit comprises an airtight body and an airtight lid located at the lower part of the airtight body. Each end of the nib airtight unit has a hole that allows the nib or its holding structure to pass through. In one embodiment, when the writing device is in use, the nib passes through the airtight body and pushes open the airtight lid, and becomes exposed outside of the shaft. When the writing device is not in use, the nib is retracted inside the airtight body and the airtight lid closes automatically. The nib airtight unit may further include an elastic structure, such as an elastic loop. One end of the elastic loop ties to the airtight body while the other end of the elastic loop ties to the airtight lid.

In accordance with yet another aspect, the airtight body comprises an upper body, a lower body, and a circular airtight seal placed between the upper and lower bodies. The airtight seal may be made of soft, elastic materials, and shaped to match with the cross section of the nib or its holding structure. The airtight seal has a hole in the center, whose diameter is smaller than the outer diameter of the nib or its holding structure. The hole allows the nib or its holding structure to pass through by force. Consequently, the airtight seal holds the nib or its holding structure tightly, thus strengthening the airtight effect.

In accordance with a further aspect, to further strengthen the airtight effect of the lower end of the airtight body, the lower end of the airtight body opposite the lid may include a circular groove, which is embedded with a sealing ring made of soft, elastic materials. The sealing ring may protrude partly over the surface of the lower part of the airtight body. Alternatively, the sealing ring may be attached to the corresponding surface of the airtight lid.

In summary, embodiments of the invention provide a retractable writing device that contains a nib airtight unit with a lid. The airtight unit and lid provide an effective, stable, and durable structure for protecting various shapes of nibs when the nibs are retracted.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The following description provides an overview and detailed description of one example of an airtight retractable writing device constructed in accordance with the present invention. Further provided is an applied example for operating such a writing device. While illustrative examples are described herein and parts for assembling embodiments of the invention are shown, these specific examples and parts are not intended to be exhaustive or to limit the invention to the precise forms disclosed. For example, the preferred embodiment described in detail below illustrates a fluorescent marker. However, the invention is applicable to any retractable writing device, especially when the writing material in the writing device is volatile. Moreover, the particular number, shape, and size of parts described herein are not limiting to the invention, as parts may be combined or divided out in manufacturing (thus reducing or increasing the number of parts). The shape or size of parts may also be modified or parts may be eliminated or added without departing from the scope of the invention as defined by the claims. Such alternative designs can be assembled and achieve the benefits and advantages of the present invention.

Structure and Assembly of an Embodiment

Figure 1:
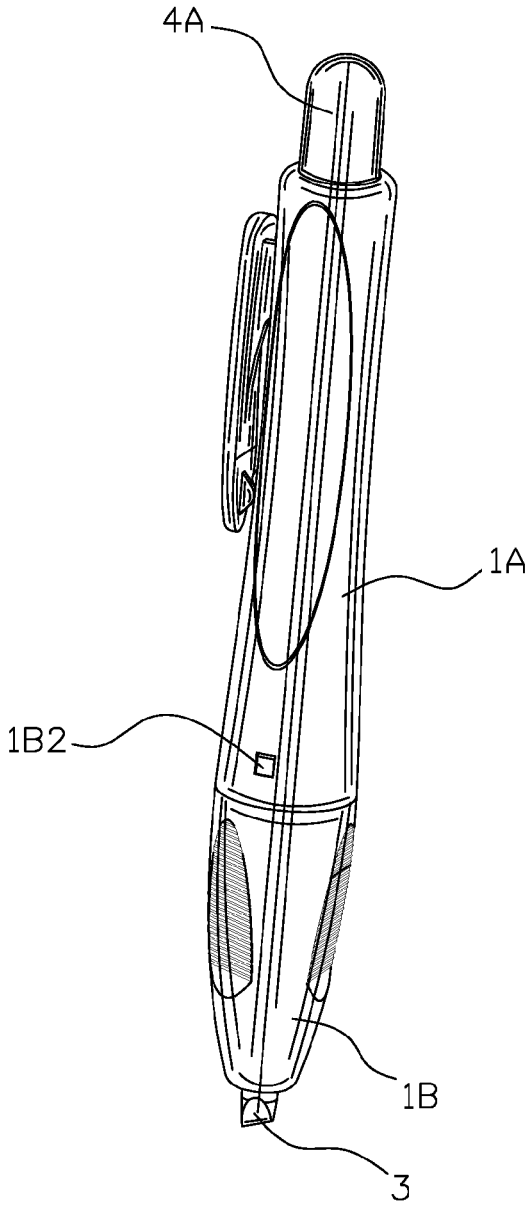
FIG. 1 is a rear right perspective view of a pushing and retractable fluorescent marker according to one embodiment of the invention, wherein the nib of the marker extends outside the shaft of the marker.
Figure 2:
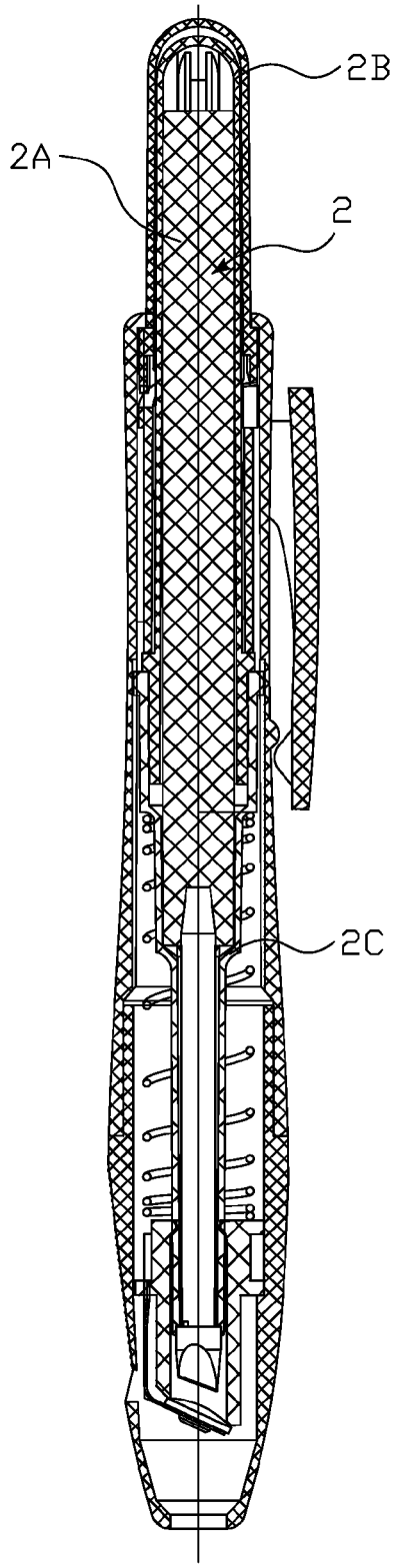
FIG. 2 is a left side sectional view of the marker illustrated in FIG. 1, wherein the nib of the marker is retracted and hidden in the shaft of the marker.
Figure 3:
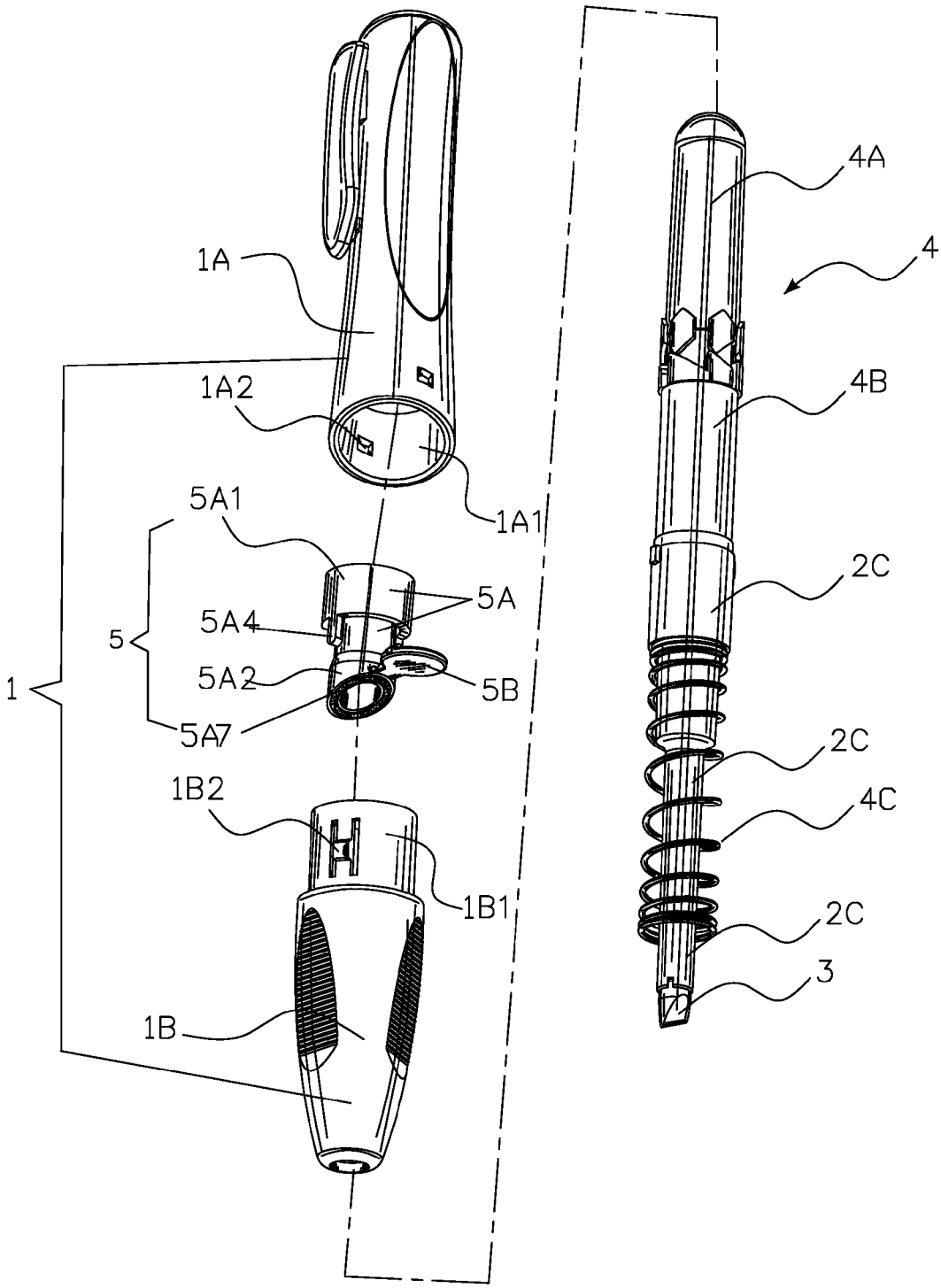
FIG. 3 is a front right exploded view of the marker illustrated in FIG. 1.

FIGS. 1-7 illustrate a structure and assembly of one exemplary embodiment of an airtight pushing and retractable fluorescent marker (hereinafter "marker") constructed in accordance with the present invention. As shown in FIGS. 1-3, this embodiment of the marker comprises a shaft 1, an ink-box 2, a nib 3, a retractable unit 4, and a nib airtight unit 5. The discussion below describes in detail an exemplary embodiment for each of these components of the marker.

Figure 6:
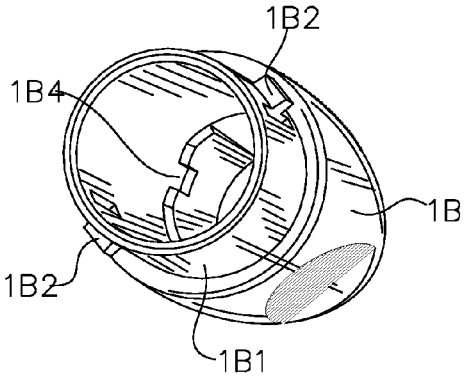
FIG. 6 is a perspective view of the lower shaft of the marker illustrated in FIG. 1.

As shown in FIG. 3, the shaft 1 comprises an upper shaft 1A and a lower shaft 1B. The lower end of the upper shaft 1A contains a thin interface 1A1 and a couple of symmetric holes 1A2. Correspondingly, the upper end of the lower shaft 1B contains a thin interface 1B1 and a couple of symmetric flanges 1B2. As shown in FIG. 6, this exemplary embodiment includes straight grooves 1B4 on the inner wall of the lower shaft 1B. The grooves 1B4 are configured to receive flanges 5A4 (FIG. 4A) as will be discussed later herein. The interface 1B1 of the lower shaft 1B is inserted into the interface 1A1 of the upper shaft 1A. The symmetric flanges 1B2 are embedded in the symmetric holes 1A2. In such a way, the upper shaft 1A and the lower shaft 1B are joined together.

Figure 7:
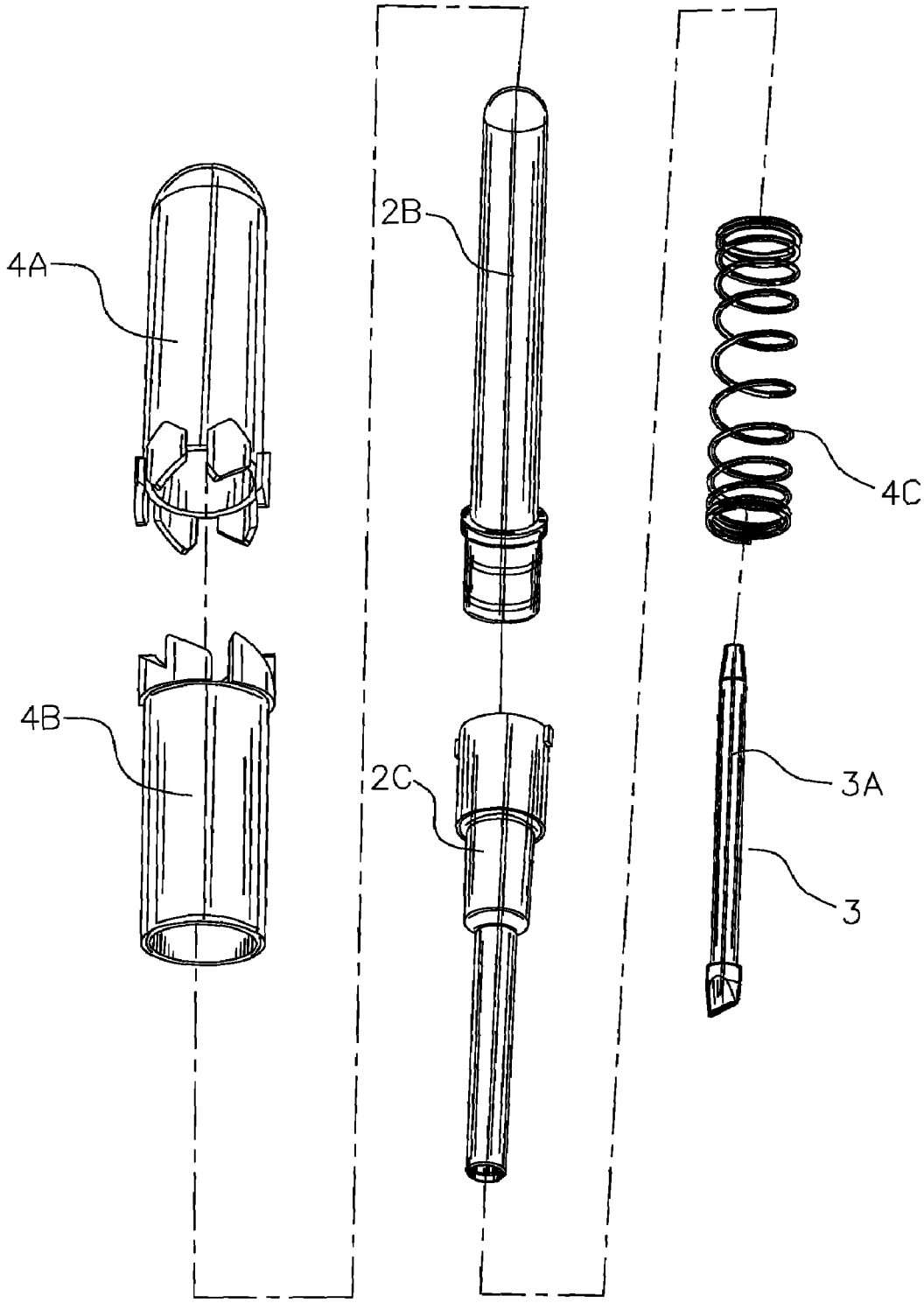
FIG. 7 is an exploded perspective view of the ink-box and retractable unit for the marker illustrated in FIG. 3.

As shown in FIGS. 2, 3, and 7, the ink-box 2 comprises a packed wick 2A, an inner shaft 2B, and a middle shaft 2C. The packed wick 2A is inserted inside the inner shaft 2B, which is fixed together with the middle shaft 2C. The upper section 3A of the nib 3 is inserted tightly into the lower end of the middle shaft 2C and connected to the packed wick 2A. The lower end of the middle shaft 2C includes a nib clip.

As shown in FIG. 3, the retractable unit 4 comprises a push-button 4A, a roller 4B, a return spring 4C, and a straight flange (not shown) inside the shaft. The straight flange refers to the characteristic of a long straight groove (not shown in the drawings). The return spring 4C is slipped over the middle shaft 2C. Because pushing structures suitable for controlling the retractable unit 4 are well known in the industry, further details herein are not necessary to implement the pushing structure.

Figure 4A:
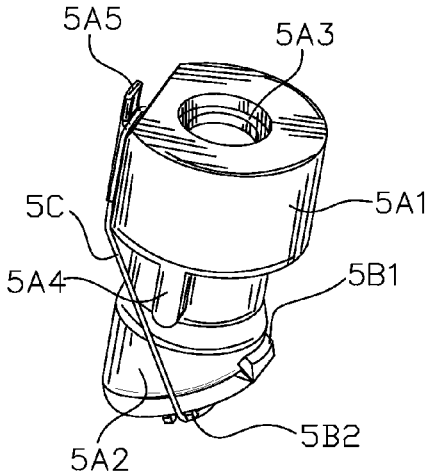
FIG. 4A is an upper perspective view of a nib airtight unit suitable for use in the marker illustrated in FIG. 1, wherein the lid of the nib airtight unit is closed.
Figure 4B:
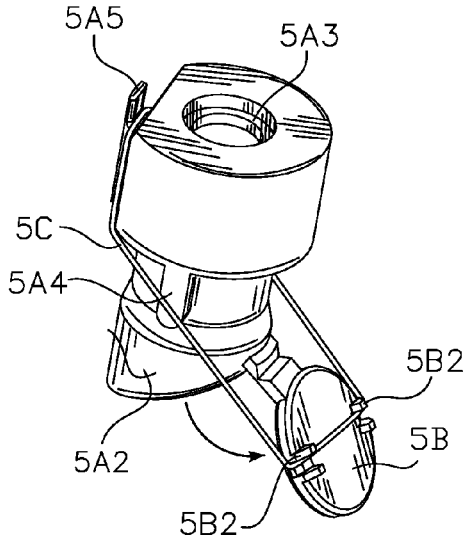
FIG. 4B is an upper perspective view of a nib airtight unit suitable for use in the marker illustrated in FIG. 1, wherein the lid of the nib airtight unit is pushed open.
Figure 5:
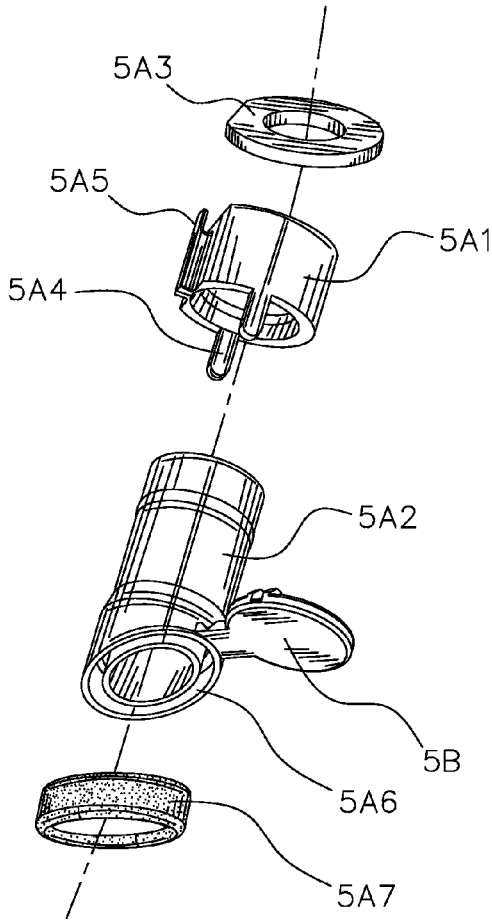
FIG. 5 is a lower perspective and exploded view of the nib airtight unit illustrated in FIGS. 4A-4B.

As shown in FIGS. 3-5, the nib airtight unit 5 comprises an airtight body 5A, an airtight lid 5B, and an elastic loop 5C, which can be a rubber band or spring, for example. In an exemplary embodiment of the invention, the airtight body 5A includes an upper body 5A1, a lower body 5A2, and an airtight seal 5A3. The lower body 5A2 is tightly fitted to the upper body 5A1. The airtight lid 5B and the lower body 5A2 may be constructed as one unit, which may be cast with a flexible organic plastic. The airtight lid 5B and the lower body 5A2 connect at a uniting section 5B 1.

The airtight seal 5A3 is pressed between the lower body 5A2 and the upper body 5A1. The center of the airtight seal 5A3 has a hole, whose diameter preferably is less than that of the upper section 3A of the nib 3. Made of elastic or soft materials, the airtight seal 5A3 not only allows the upper section 3A of the nib 3 to be inserted there through and to move up and down, but also continuously seals against the upper section 3A of the nib 3.

As shown in FIGS. 4A and 4B, to ensure the airtight function of the lid 5B, the airtight unit 5 may further include an elastic loop 5C. The elastic loop 5C may be made of organic material with high elasticity or may be a metallic or plastic spring. The airtight lid 5B may include lower agraffes 5B2, which are used to secure one end of the elastic loop 5C. The other end of the elastic loop 5C may be secured to an upper agraffe 5A5 on the upper body 5A1. When the nib 3 is retracted within the airtight unit 5, the elastic loop 5C forces the lid 5B to shut against the lower body 5A2, as shown in FIG. 4A. When the nib 3 is extended outward from the airtight unit, the nib 3 forces the lid 5B to go open, for example as shown in FIG. 4B.

Figure 5A:
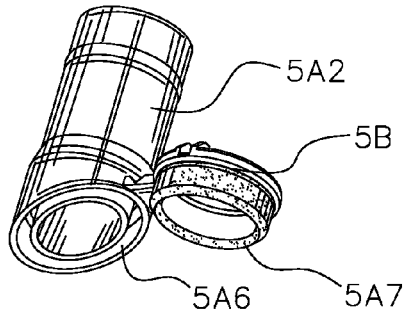

Optionally, to further enhance the airtight function of the lid 5B, a sealing ring 5A7 made of soft materials may be provided. The sealing ring 5A7 may be secured to the surface of the lower part of the lower body 5A2, as shown in FIG. 5, or the corresponding surface of the airtight lid 5B, as shown in FIG. 5A. As shown in FIG. 5, the lower part of the lower body 5A2 includes a circular groove 5A6 into which the sealing ring 5A7 may be tightly fitted. As shown in FIG. 3, the sealing ring 5A7 protrudes partly over the surface of the lower part of the airtight body 5A. In addition, as shown in FIG. 2, the surface of the lower part of the airtight body that is opposite the airtight lid may be configured at an incline relative to a longitudinal axis that extends through the airtight body.

As shown in FIGS. 4A and 4B and in FIG. 6, the upper body 5A1 of the airtight body 5A includes flanges 5A4, which fit to the straight grooves 1B4 on the inner wall of the lower shaft 1B. The flanges 5A4 and the straight grooves 1B4 thus secure the nib airtight unit 5 within the lower shaft 1B.

Operation of the Disclosed Embodiment

Once the marker is assembled, for example, according to the embodiment described above, the nib 3 of the marker can extend or retract upon the pushing of the push-button 4A. When the marker is not in use, as shown in FIG. 2, the push-button 4A returns to the top of the marker by the force of the return spring 4C. The nib 3 retracts inside the airtight body 5A while the airtight lid 5B is closed against the airtight unit 5 by the force of the elastic loop 5C. When the marker is to be used, as shown in FIG. 1, the push-button 4A is pushed down, which compresses the return spring 4C. In turn, the nib 3 moves down the shaft 1 along with the ink-box 2 and the middle shaft 2C until the nib 3 extends outside the lower shaft 1B and is ready for writing. The downward movement of the nib 3 forces the lid 5B to open and allow the nib 3 to extend outside the shaft 1. When the push-button 4A is pushed again, the nib returns to the retracted state shown in FIG. 2. When the nib is retracted, the elastic loop 5C pulls the lid 5B shut, thus returning the unit 5 to an airtight state.

In exemplary embodiments of the invention, if the packed wick 2A of the ink-box 2 is saturated with florescent ink, the marker may be considered a pushing and retractable fluorescent pen. If the packed wick 2A is saturated with marker ink, the marker may be considered a pushing and retractable marker.

While an exemplary embodiment of the marker has been illustrated and described above, along with alternative embodiments and an exemplary implementation of the marker, it will be appreciated that various changes can be made therein without departing from the spirit and scope of the invention. The scope of the invention should be determined from the following claims and equivalents thereto.

The embodiments of the invention in which an exclusive property or privilege is claimed are defined as follows:

1. An airtight retractable writing device, comprising:

a shaft;

an ink-box inside the shaft;

a nib connected with the ink-box;

a retractable unit controlling movement of the nib within the shaft; and a nib airtight unit with a lid that prevents the nib from drying when the nib is retracted inside the shaft, wherein the nib airtight unit includes an airtight body having:

an upper body;

a lower body separate from the upper body, wherein the lower body has an outside diameter that is less than an inside diameter of the upper body such that the lower body is inserted telescopically into the upper body and is tightly fitted to the upper body; and an airtight seal pressed between the upper body and the lower body, wherein the center of the airtight seal has a hole whose diameter is smaller than the diameter of the nib or a structure holding the nib while permitting the nib or its holding structure to pass through the hole, and wherein the outside of the airtight body includes two or more flanges that engage two or more grooves inside the lower portion of the shaft.

2. The writing device of claim 1, wherein the airtight lid is located at a lower part of the airtight body; and wherein the airtight body has a hole on each end that allows the nib or its holding structure to pass through;

wherein when the writing device is in use, the nib passes through the airtight body to push open the airtight lid, and becomes exposed outside the shaft; and wherein when the writing device is not in use, the nib is retracted inside the airtight body and the airtight lid closes automatically against the airtight body.

3. The writing device of claim 2, wherein the nib airtight unit further includes an elastic loop, wherein one end of the elastic loop secures to the airtight lid, and the other end of the elastic loop secures to the airtight body, and wherein the elastic loop forces the airtight lid to close automatically against the airtight body when the nib is retracted inside the airtight body.

4. The writing device of claim 1, wherein the airtight seal is made of an elastic or soft material.

5. The writing device of claim 2, further comprising a sealing ring secured to a surface of the airtight body that is opposite to a surface of the airtight lid.

6. The writing device of claim 2, further comprising a sealing ring secured to a surface of the airtight lid that is opposite to a surface of the airtight body.

7. The writing device of claim 2, wherein the lower part of the airtight body includes a circular groove, which is embedded with a sealing ring.

8. The writing device of claim 7, wherein the sealing ring protrudes partly over the surface of the lower part of the airtight body.

9. The writing device of claim 2, wherein a surface of the lower part of the airtight body that is opposite the airtight lid is inclined relative to a longitudinal axis extending through the airtight body.

10. The writing device of claim 1, wherein the shaft includes an upper shaft and a lower shaft, each having an interface, and wherein the upper shaft and the lower shaft are united by inserting the interface of the lower shaft into that of the upper shaft.

11. The writing device of claim 10, wherein the outside of the interface of the lower shaft includes two or more flanges and correspondingly, the interface of the upper shaft includes two or more holes for receiving the flanges of the lower shaft.

12. The writing device of claim 10, wherein the nib airtight unit is located in the lower shaft.

13. The writing device of claim 1, wherein the retractable unit includes a push-button and roller structure, and a return spring is fixed between the ink-box and the nib airtight unit.

* * * * *